US008734169B2

(12) United States Patent
Werner et al.

(10) Patent No.: US 8,734,169 B2
(45) Date of Patent: May 27, 2014

(54) METHOD OF LOCATING SMT CONNECTOR WITH SMT CAP FEATURE

(75) Inventors: Christopher M. Werner, San Jose, CA (US); Trent K. Do, Milpitas, CA (US); Hamid R. Mohammadinia, San Jose, CA (US)

(73) Assignee: Apple Inc., Cupertino, CA (US)

( * ) Notice: Subject to any disclaimer, the term of this patent is extended or adjusted under 35 U.S.C. 154(b) by 29 days.

(21) Appl. No.: 13/610,694

(22) Filed: Sep. 11, 2012

(65) Prior Publication Data

US 2014/0073149 A1 Mar. 13, 2014

(51) Int. Cl.
*H01R 12/00* (2006.01)

(52) U.S. Cl.
USPC ..... 439/135; 29/825; 29/842; 29/874; 29/876; 29/883

(58) Field of Classification Search
USPC ..... 29/825, 842, 874, 876, 883; 439/79, 439/135
See application file for complete search history.

(56) References Cited

U.S. PATENT DOCUMENTS

| | | | | |
|---|---|---|---|---|
| 7,828,564 | B2 * | 11/2010 | Guan et al. | 439/135 |
| 8,367,926 | B2 * | 2/2013 | Peng et al. | 174/17 R |
| 2003/0027445 | A1 * | 2/2003 | Carney et al. | 439/135 |

* cited by examiner

*Primary Examiner* — Gary Paumen
(74) *Attorney, Agent, or Firm* — Kilpatrick Townsend & Stockton LLP

(57) ABSTRACT

An improved electronic connector with alignment features is disclosed. One or more alignment features for the connector are disposed on a removable SMT cap that attaches to an external face of the connector. Placing one or more alignment features in the SMT cap may enable fewer alignment features on the device PCB, resulting in increased space for electrical routing and other electrical components.

20 Claims, 8 Drawing Sheets

METHOD OF LOCATING SMT CONNECTOR WITH SMT CAP FEATURE

BACKGROUND OF THE INVENTION

The present invention relates generally to electrical connectors and in particular to electrical connectors that are mounted to a printed circuit board within an electronic device. A wide variety of electronic devices are available for consumers today. Many of these devices have connectors that that facilitate communication with and/or charging of a corresponding device. These connectors often interface with other connectors through cables that are used to connect devices to one another. Sometimes, connectors are used without a cable to directly connect the device to another device, such as a charging station or a sound system.

As smart-phones, media players and other electronic devices become more compact, a limiting factor on the size of a particular device may be the size of the printed circuit board (PCB) within the device. Typically, very compact electronic devices may only have one printed circuit board on which one or more connectors along with all the other electronic components and electrical routing are located. As an example, receptacle connectors are sometimes positioned on one or more of the side surfaces of portable media devices and are mounted to a printed circuit board within the device. In relatively small media devices, the receptacle connectors may consume a significant portion of the available space on the PCB, leaving little room for additional electrical routing and other electronic components.

Thus, new connectors may require new features and/or changes to commonly used connectors to be able to consume less space on a printed circuit board, leaving more space for other electrical components and electrical routing.

BRIEF SUMMARY OF THE INVENTION

Embodiments of the invention pertain to technology that is particularly useful in the manufacture of especially compact electronic devices requiring increased PCB space for electrical routing and other electronic components.

Some embodiments relate to the formation of electronic connectors that may have an SMT cap attached to an outside face of the electronic connector. The SMT cap may have one or more connector alignment features disposed on a bottom surface that may be used for aligning the connector to the PCB. Further, the SMT cap may sit on a PCB rail that may be removed from the PCB panel prior to installation of the PCB into an electronics device. This may enable fewer connector alignment features to be placed on the portion of the PCB that fits within the electronic device, freeing up PCB space for additional electrical routing or electronic components.

Some embodiments of the invention may have one or more alignment features on the SMT cap and one or more alignment features on the rear of the connector. Other embodiments may have two or more alignment features in the SMT cap and no alignment features on the rear of the connector. Further embodiments may not have an SMT cap and may have a portion of the connector body formed into an alignment feature disposed on the front face of the connector. After assembly, this alignment feature may be removed.

In some embodiments the alignment features may be cylindrically shaped and fit into corresponding circular apertures in the PCB. In other embodiments, cylindrically shaped alignment features may fit into one or more slotted apertures in the PCB. In further embodiments, one or more of the alignment features may not be cylindrically shaped and may be, for example, in the shape of a blade.

Some embodiments of the invention relate to assembling a plurality of connectors with SMT alignment features on a PCB containing a plurality of device PCBs.

To better understand the nature and advantages of the present invention, reference should be made to the following description and the accompanying figures. It is to be understood, however, that each of the figures is provided for the purpose of illustration only and is not intended as a definition of the limits of the scope of the present invention.

DETAILED DESCRIPTION OF THE INVENTION

Certain embodiments of the present invention relate to electrical connectors assembled to PCBs that may be employed in electronic devices. While the present invention can be useful to produce connector/PCB assemblies for a wide variety of electronic devices, some embodiments of the invention are particularly useful for producing connector/PCB assemblies for electronic devices that require increased room on the PCB for electrical routing or other electronic components, as described in more detail below.

Figure 1:
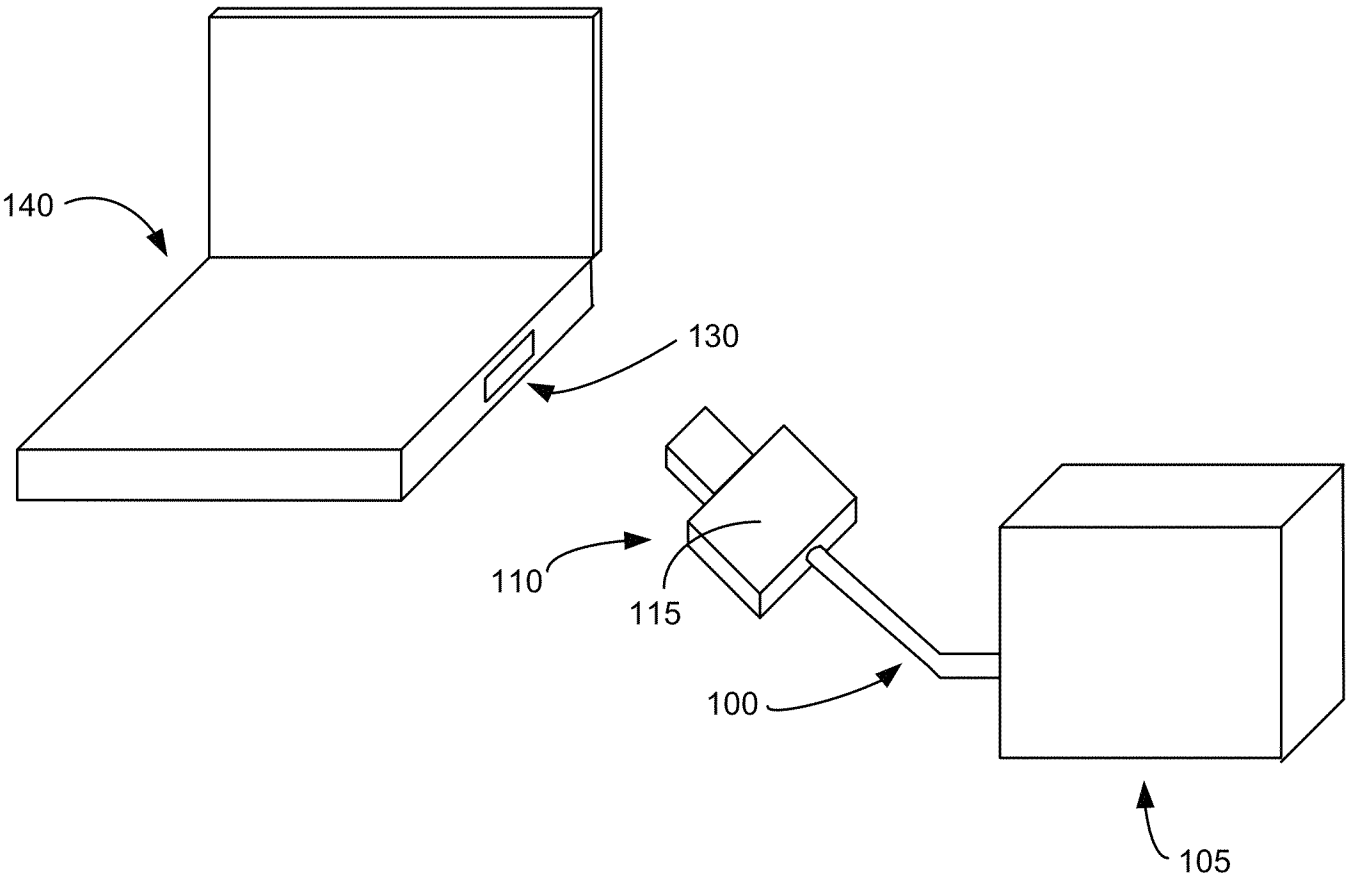
FIG. 1 is a diagram that illustrates an example of an electronic device and a peripheral device employing a receptacle connector and a connector plug, respectively.

Certain embodiments of the present invention relate to electrical connectors employed in electronic devices. Many electronic devices such as smart-phones, media players, and tablet computers have electronic connectors that facilitate battery charging and/or communication with other devices. The connectors include a plurality of electrical contacts through which electrical connections are made to another compatible connector to transfer power and/or data signals through the connectors. FIG. 1 illustrates an example of two such connectors including a plug connector 110 and a receptacle connector 130. Each of these connectors 110, 130 may comply with a well-known standard such as Universal Serial Bus (USB) 2.0, Firewire, Thunderbolt, or the like or may be proprietary connectors, such as the 30-pin connector used on many Apple products among other types of proprietary connectors.

As further shown in FIG. 1, plug connector 110 is coupled to a cable 100, which in turn is coupled to a peripheral device 105 that can be any of many different electronic devices or accessories that operate with such devices. Receptacle connector 130 is incorporated into a computing device 140. When the plug connector 110 is mated with the receptacle 130, electrical contacts within each electronic connector (not shown in FIG. 1) are in physical and electrical contact with each other to allow electrical signals to be transferred between computing device 140 and peripheral device 105.

To further illustrate embodiments of the invention, various examples of electrical connectors that include alignment features that may be made in accordance with the present invention are discussed below, however these embodiments should in no way limit the applicability of the invention to other connectors.

Figure 2B:
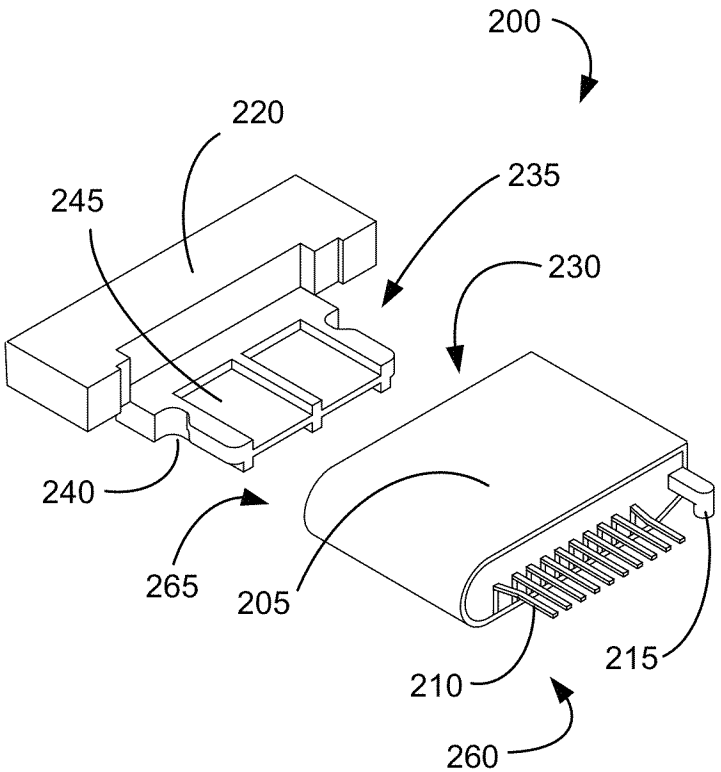
FIG. 2B is a diagram that illustrates a top perspective view of an electrical connector with an SMT cap in accordance with an embodiment of the invention.
Figure 2A:
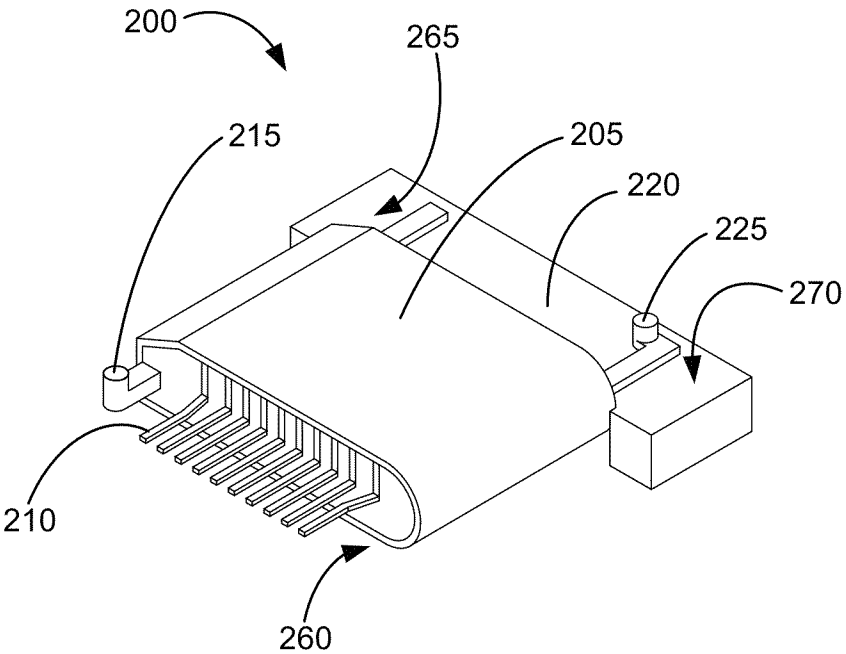
FIG. 2A is a diagram that illustrates a bottom perspective view of an electrical connector with an SMT cap in accordance with an embodiment of the invention.

FIG. 2A is a simplified perspective view of the bottom surface of an exemplary receptacle connector assembly 200, in accordance with one embodiment of the invention. Connector assembly 200 may include a connector body 205 that may have a plurality of electrical leads 210 disposed on a rear external face 260, for mounting to a PCB. A PCB as used herein may be any type of planar structure used to route electrical signals such as, for example, epoxy-glass with metallic traces, low-temperature co-fired ceramic with metallic traces, polyamide layers with metallic traces (flex-PCB's), or selectively plated plastic. Connector assembly 200 may also have a surface mount technology (SMT) alignment feature 215 protruding from a rear external face 260 of connector body 205 for aligning the connector assembly on a PCB. Connector assembly 200 may further have a removable SMT cap 220 affixed to a front exterior face 265 of connector body 205. SMT cap 220 may be manufactured from, for example, a plastic such as nylon or liquid crystal polymer. SMT cap 220 may also have an alignment feature 225 protruding from bottom surface 270 of the SMT cap for aligning connector assembly 200 on a PCB. Placing one or more alignment features, like pin 225, on the SMT cap may save PCB space, as will be illustrated in more detail below.

The top side of connector assembly 200 is depicted in FIG. 2B. In this illustration, SMT cap 220 has been removed from exterior face 265 of connector body 205. SMT cap 220 may be affixed to the front exterior face 265 of connector body 205 by inserting a latching tongue 235 that includes one or more retention mechanisms 240 (e.g., opposing recesses formed in sides of tongue 235) of SMT cap 220 into a receptacle cavity 230 of the connector body. Tongue 235 may be sized and shaped generally the same as a corresponding plug connector that mates with the receptacle connector. Latching retention mechanisms 240 can be adapted to engage with a retention feature, e.g., a spring or detent, within the receptacle connector. Latching tongue 235 can also include one or more cutouts 245 on each side of the tongue to reduce or prevent warpage of the tongue.

Figure 3:
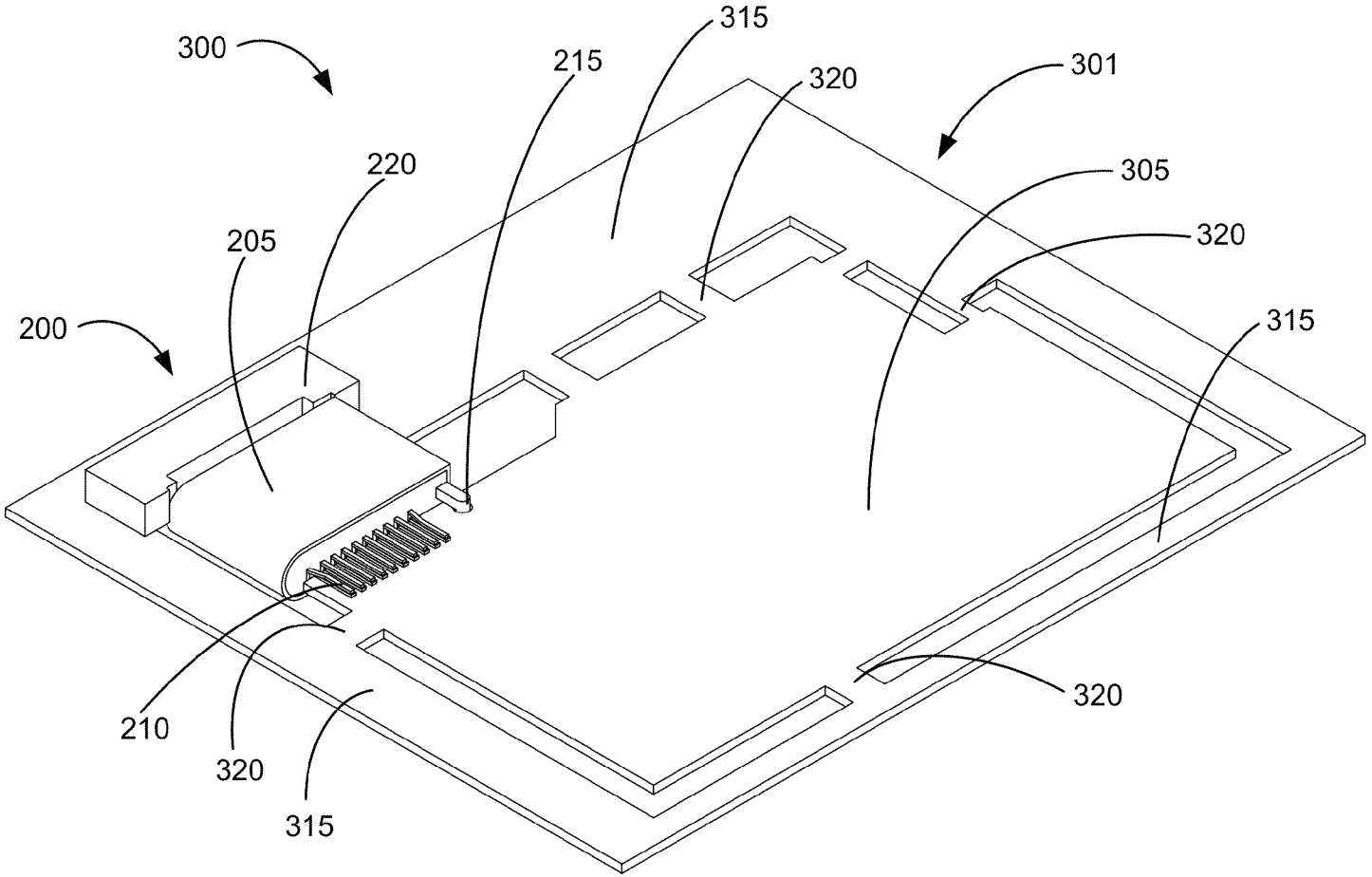
FIG. 3 is a diagram that illustrates a top perspective view of an electrical connector with an SMT cap on a PCB in accordance with an embodiment of the invention.

Connector assembly 200 is shown mounted on a PCB panel 301 in FIG. 3. This figure may be representative of one of the many assembly processes for PCB assembly 300, which will be illustrated in more detail below. A device PCB 305 may be centrally located in PCB panel 301 and may be the portion of PCB panel 301 that can be installed in an exemplary electronic device 140 (see FIG. 1). PCB panel 301 may have one or more PCB rails 315 that may be connected to device PCB 305 by removable tabs 320. PCB rails 315 may protect device PCB 305 from damage during the manufacturing process, may facilitate handling of the device PCB, and may also contain electrical test coupons to verify the device PCB was manufactured properly. Further, PCB rails 315 may provide mounting support for electronic components such as connector 200. As shown in FIG. 3, electrical leads 210 of connector body 205 may be mounted to device PCB 305. Connector assembly 200 may be supported on PCB panel 301 by electrical leads 210 and SMT cap 220. The combination of the electrical leads and the SMT cap may provide the only support for connector body 205, as PCB panel 301 may be cut away beneath the entire connector body 205. Further, connector assembly 200 may be aligned to PCB panel 301 using one or more alignment features 215. One alignment feature 215 is illustrated in FIG. 3, and extends from the rear external face 260 (see FIG. 2A) of connector body 205 and fits within a corresponding aperture in device PCB 305. Alignment feature 215 may be used to properly align electrical leads 210 on PCB pads (not shown) on device PCB 305.

Figure 4:
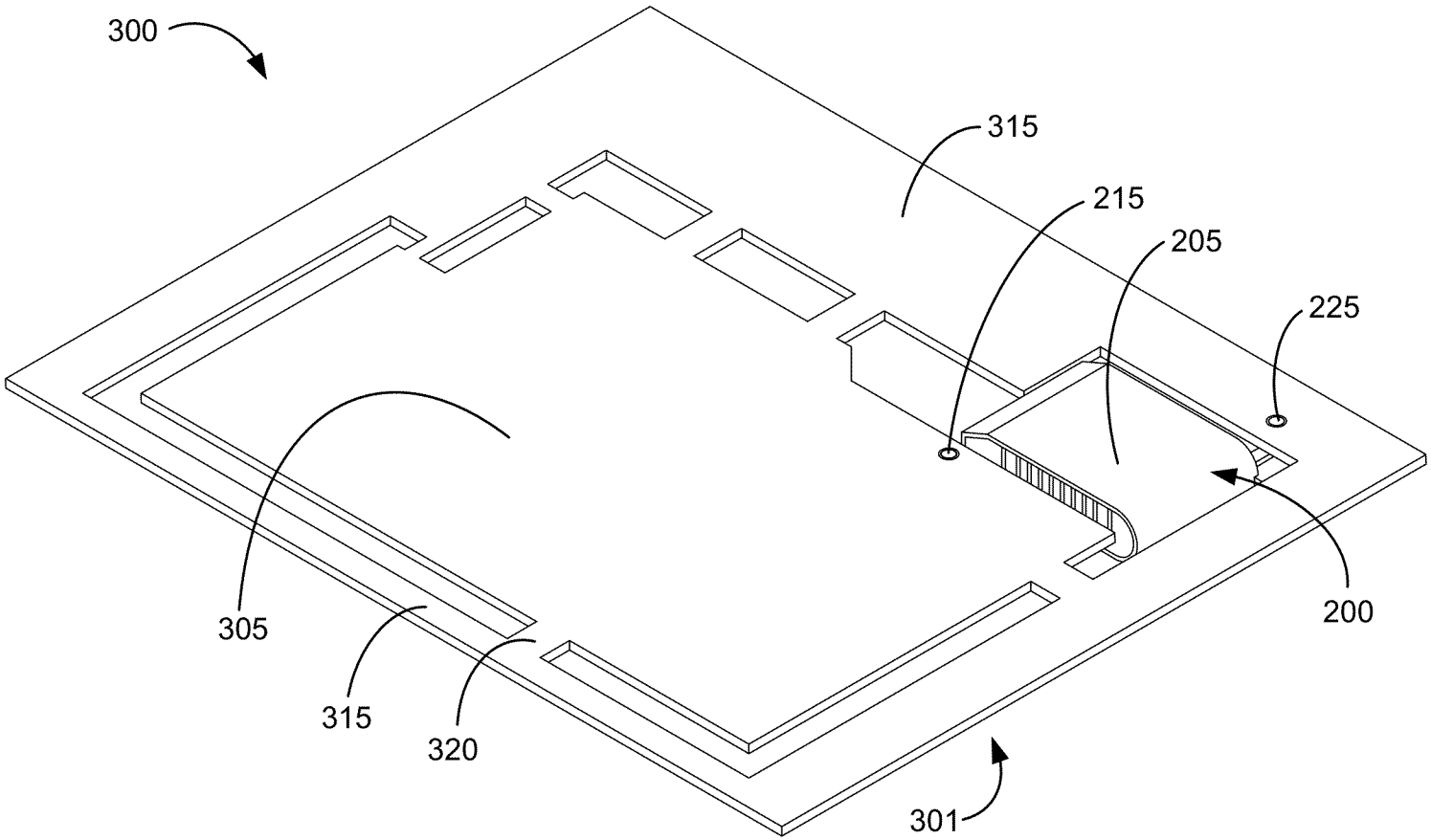
FIG. 4 is a diagram that illustrates a bottom perspective view of an electrical connector with an SMT cap on a PCB in accordance with an embodiment of the invention.

A simplified perspective view of the bottom side of PCB assembly 300 is shown in FIG. 4. From this view it can be seen that connector assembly 200 may be aligned to PCB panel 301 using two alignment features 215, 225. In some embodiments, connector assemblies may require at least two alignment features to properly locate connector body 205 and electrical leads 210 on device PCB 305. As illustrated here, alignment features 215, 225 may be cylindrical pins that may be disposed in circular apertures in the PCB panel. However, the apertures may be any shape, for example, oval, slotted or square. Alignment feature 225 may extend from bottom surface 270 (see FIG. 2A) of SMT cap 220 and be disposed in an aperture in PCB rail 315, while alignment feature 215 may extend from rear face 260 (see FIG. 2A) of connector body 205 and be disposed in an aperture in device PCB 305. By disposing alignment feature 225 in PCB rail 315, and not on device PCB 305, additional space can be used on device PCB for electrical routing and other electronic components. To save even more space on device PCB 305 (see FIG. 3), some embodiments of connector assembly 200 may place more than one alignment feature on SMT cap 220 and no alignment features on connector body 205.

Figure 5:
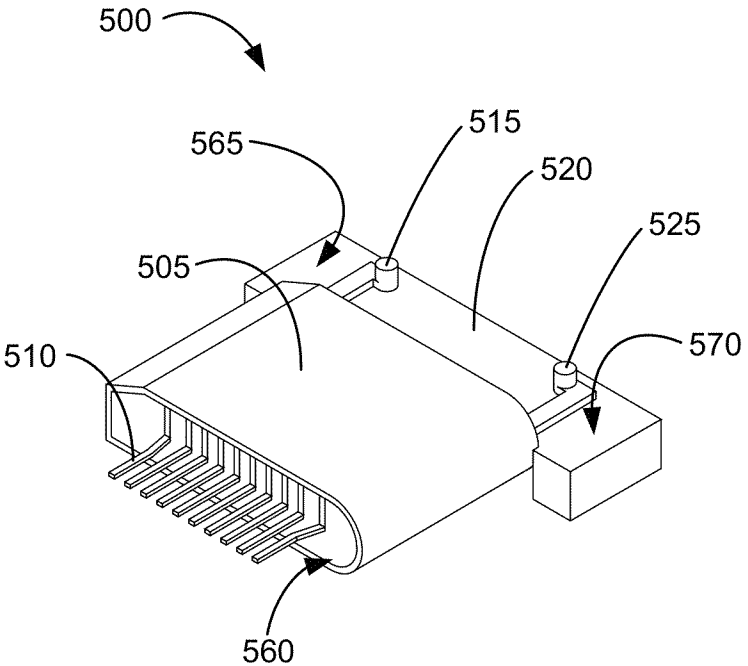
FIG. 5 is a diagram that illustrates a bottom perspective view of an electrical connector with an SMT cap in accordance with an embodiment of the invention.

One such embodiment that has alignment features only disposed on SMT cap 520 is connector assembly 500, depicted in FIG. 5. This figure shows a simplified perspective view of the bottom surface of an exemplary receptacle connector assembly 500. Connector assembly 500 may include a connector body 505 that may have a plurality of electrical leads 510 disposed on a rear external face 560, for mounting to a PCB. Connector assembly 500 may have a removable SMT cap 520 affixed to a front exterior face 565 of connector body 505. SMT cap 520 may have two alignment features 515, 525 protruding from a bottom surface 570 of the SMT cap for aligning the connector assembly on a PCB. More specifically, both alignment features 515, 525 located on SMT cap 520 may be fitted within apertures disposed in PCB rail 315 (see FIG. 3) and no alignment features may be disposed in apertures in device PCB 305. Because no alignment features are disposed in device PCB 305 (see FIG. 3), this embodiment may save even more space on the device PCB for electrical routing and other electronic components than connector assembly 200.

Many combinations of alignment features may be employed without departing from the invention. More specifically, the number of alignment features on connector body 505 and SMT cap 520 can be varied. Some embodiments may have no alignment features on connector body 505 and all the alignment features on SMT cap 520, while other embodiments may have one or more alignment features disposed on connector body 505 and one or more features disposed on SMT cap 520. Other embodiments may have one or more alignment features that are not pins, but are for example, diamond shapes, tapered cylinders, octagons, hexagons, squares and blades.

Figure 6:
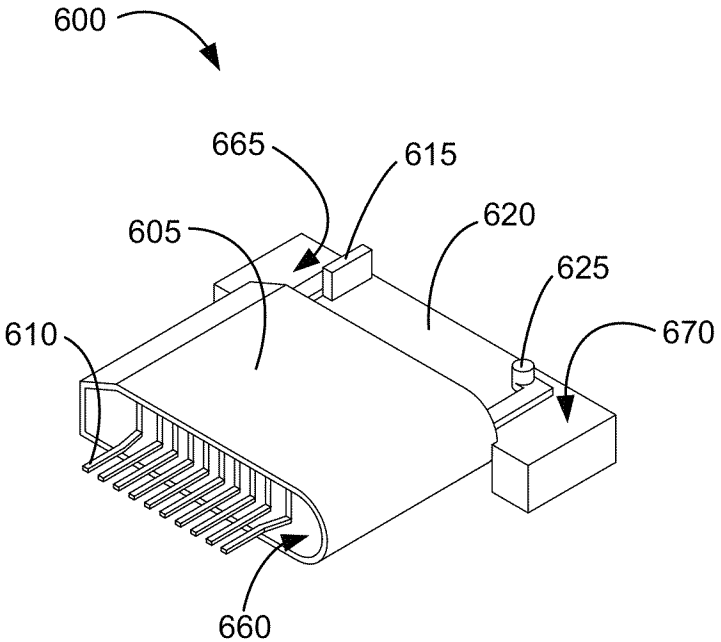
FIG. 6 is a diagram that illustrates a bottom perspective view of an electrical connector with an SMT cap in accordance with an embodiment of the invention.

One such embodiment having a non-cylindrical alignment feature is depicted in FIG. 6, which shows a simplified perspective view of the bottom surface of an exemplary receptacle connector assembly 600. Connector assembly 600 may include a connector body 605 that may have a plurality of electrical leads 610 disposed on a rear external face 660, for mounting to a PCB. Connector assembly 600 may have a removable SMT cap 620 affixed to a front exterior face 665 of connector body 605. SMT cap 620 may have one SMT alignment feature 625 in the shape of a cylinder, and one SMT alignment feature 615 in the shape of a blade, both protruding from bottom surface 670 of the SMT cap for aligning the connector assembly on a PCB. More specifically, both alignment features 615, 625 located on SMT cap 620 may be fitted within apertures in PCB rail 315 (see FIG. 3) and no alignment features may be disposed in apertures in device PCB 305, saving space on device PCB 305 for electrical routing and other components. Further, because of the rectangular shape of alignment feature 615, the corresponding aperture in PCB rail 315 may also be generally rectangular in shape, or it may be generally circular in shape.

Figure 7:
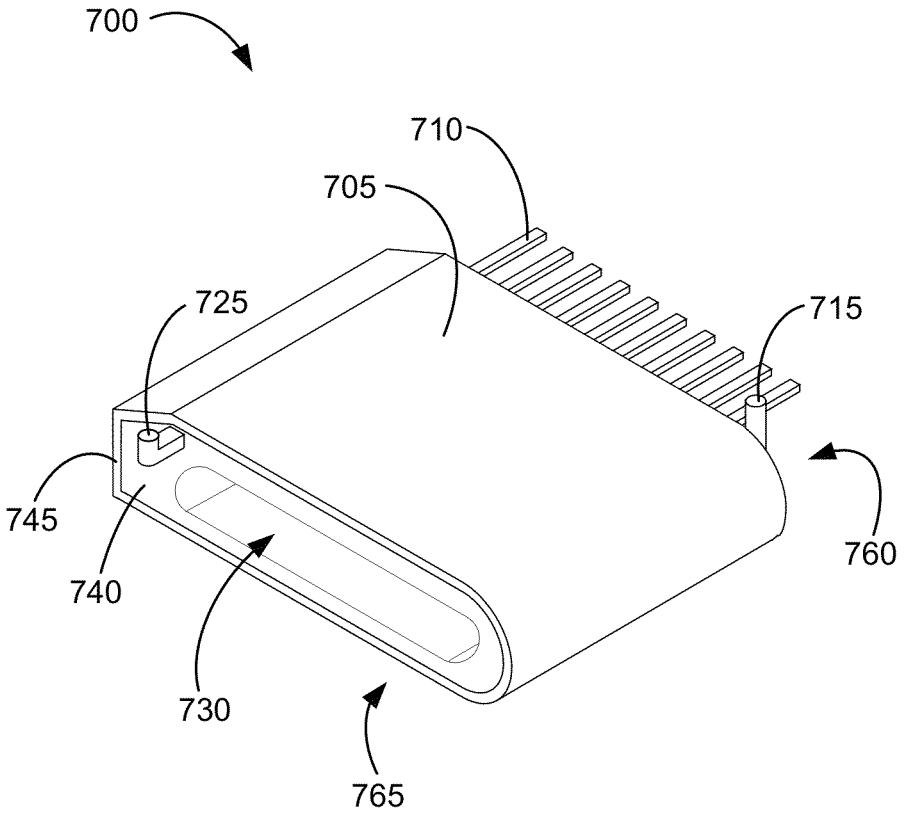
FIG. 7 is a diagram that illustrates a bottom perspective view of an electrical connector in accordance with an embodiment of the invention.

In some embodiments, as depicted in FIG. 7, there may not be an SMT cap. This figure shows a simplified perspective view of the bottom surface of an exemplary receptacle connector assembly 700. Connector assembly 700 may include a connector body 705 that may have a plurality of electrical leads 710 disposed on a rear external face 760, for mounting to a PCB. Connector body 705 may be comprised of an outer metallic shell 745 wrapped around an interior body 740 that may be substantially comprised of plastic. A front exterior face 765 of connector body 705 may have a receptacle cavity 730 for receiving the plug portion of a mating connector. Connector body 705 may further have alignment features 715, 725 for aligning connector assembly 700 on an exemplary PCB panel 301 (see FIG. 3). Alignment features 715, 725 may be cylindrical features that may be disposed in circular apertures in PCB panel 301 (see FIG. 3), similar to alignment features depicted in prior embodiments. Here, feature 725 may extend from front exterior face 765 of inner body 740 and may be positioned to be disposed in a corresponding aperture in PCB rail 315 (see FIG. 3). Feature 715 may extend from exterior rear face 760 of connector body 705 and may be positioned to be disposed in a corresponding aperture in device PCB 305 (see FIG. 3). By disposing alignment feature 725 in an aperture on PCB rail 315, and not on device PCB 305, additional space can be used on device PCB for electrical routing and other electronic components.

In some embodiments, alignment features 715, 725 are permanent, and in some embodiments they are removable after connector assembly 700 is attached to device PCB 305 (see FIG. 3). More specifically, in some embodiments, after leads 710 have been attached to device PCB, alignment feature 725 may be removed from inner body 740. Removal may be performed by simply breaking alignment feature 725 from inner body 740, or alternative methods may be used such as a cutting operation. In some embodiments, alignment feature 725 may be a part of outer metallic shell 745. In these embodiments, feature 725 may be, for example, shaped as a blade, or as an extended "V". In some of these embodiments, alignment feature 725 may be permanent, while in other embodiments the alignment feature may be removed after assembly. In further embodiments, more than one removable alignment feature may be disposed on front face 765 and in some embodiments no alignment features may be disposed on rear face 760.

Figure 8:
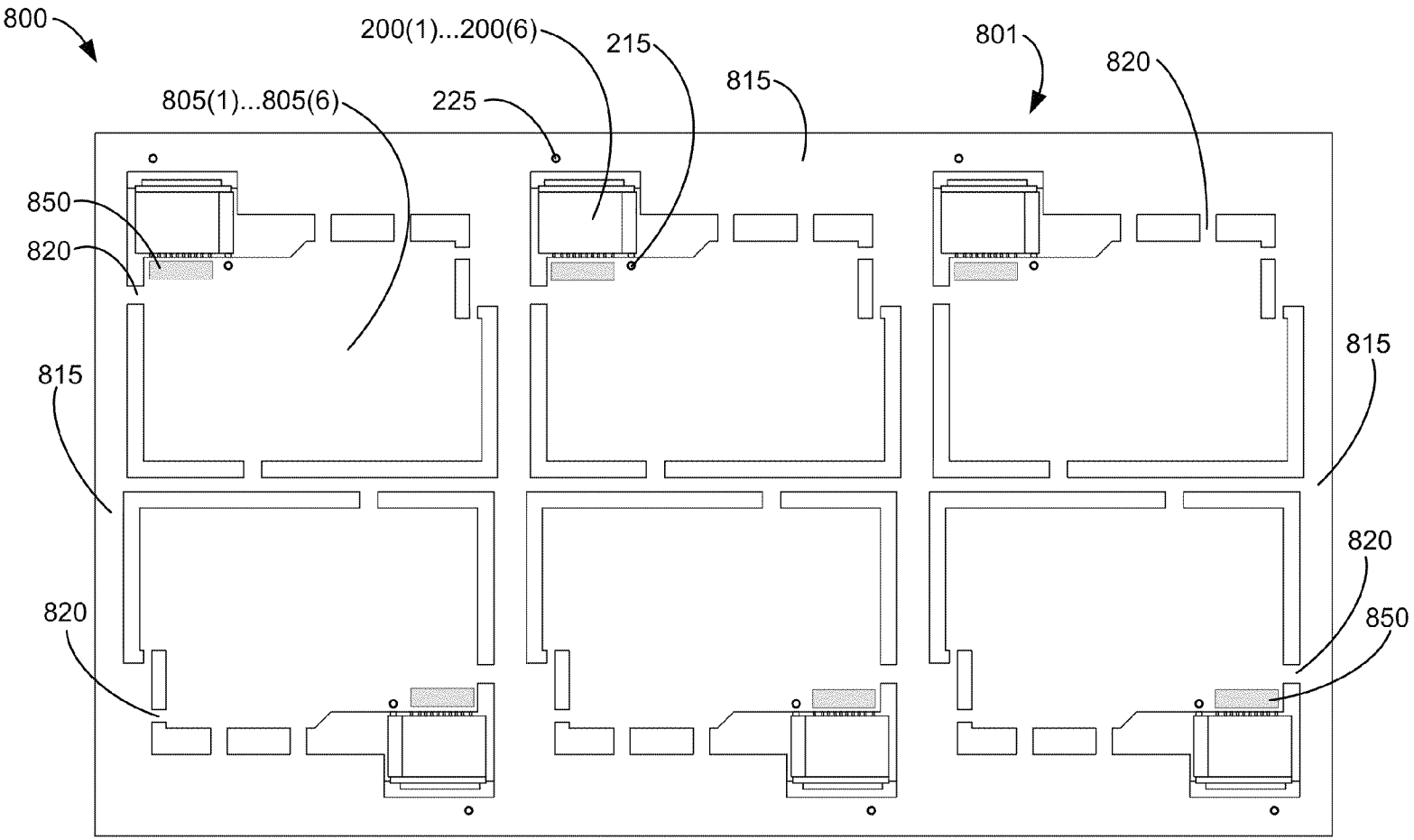
FIG. 8 is a diagram that illustrates a bottom plan view of a plurality of electrical connectors on a PCB in accordance with an embodiment of the invention.

In some embodiments, multiple exemplary connector assemblies 200(1) . . . 200(6) may be installed on a single PCB panel 801, as illustrated in FIG. 8. PCB assembly 800 may comprise six connector assemblies 200(1) . . . 200(6) disposed on a unitary PCB panel 801 during the PCB assembly process. Six device PCBs 805(1) . . . 805(6) may be centrally located in PCB panel 801 and may be the portions of PCB panel 801 that can be installed in exemplary electronic device 140 (see FIG. 1). Device PCBs 805(1) . . . 805(6) may each have an electronic component bonding pad area 850 where the leads of connector assemblies 200(1) . . . 200(6) may be disposed on device PCBs. As depicted in FIG. 8, bonding pad area 850 may be disposed on the other side of PCB panel 801 and located adjacent to the aperture in PCB rail 815 for alignment feature 225. Device PCBs 805(1) . . . 805(6) may have one or more PCB rails 815 that may be connected to device PCBs by removable tabs 820. PCB rails 815 may comprise an outer frame around device PCBs 805(1) . . . 805(6) and may also be disposed between device PCBs spanning from one edge of the frame to the opposite edge of the frame. PCB rails 815 may protect device PCBs from damage during the manufacturing process, may facilitate handling of the device PCB, and may also contain electrical test coupons to verify the device PCB was manufactured properly. Further, PCB rails 815 may provide mounting support for electronic components such as exemplary connector assemblies 200(1) . . . 200(6). Connector assemblies 200(1) . . . 200(6) may each be aligned to PCB panel 801 by one or more alignment features 215, 225. For example, feature 215 may extend from connector body 205 (see FIG. 2A) and fit within a corresponding aperture in device PCB 805(1) . . . 805(6). Feature 225 may extend from bottom surface 270 (see FIG. 2A) of SMT cap 220 and fit within a corresponding aperture in PCB rail 815. Alignment features 215, 225 of connector assembly 200(1) . . . 200(6) may be used to properly align electrical leads 210 (see FIG. 2A) on PCB pads (not shown) on device PCB 805(1) . . . 805(6). By disposing alignment feature 225 in an aperture on PCB rail 815, and not on device PCB 805(1) . . . 805(6), additional space can be used on device PCB for electrical routing and other electronic components.

Figure 9:
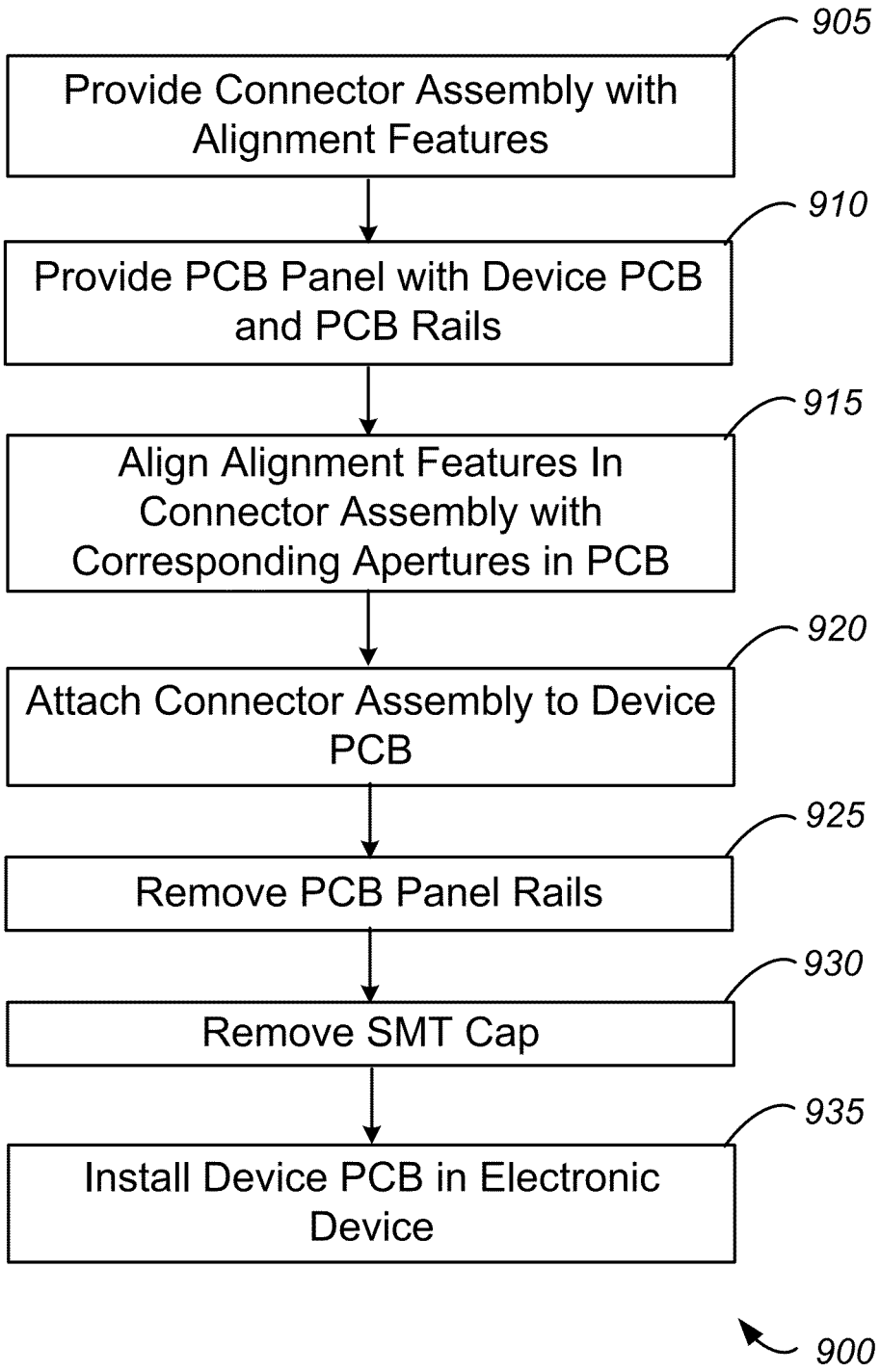
FIG. 9 is a process by which a connector with alignment features can be attached to a PCB and installed in an electronic device in accordance with an embodiment of the invention.

FIG. 9 illustrates an exemplary simplified process 900 for attaching connectors with alignment features to device PCBs that are subsequently installed in electronic devices, in accordance with embodiments described herein. In step 905 a connector with alignment features is provided. In some embodiments, one or more of the alignment features may be disposed on a removable SMT cap. In other embodiments, one or more of the alignment features may be attached to one or more external faces of the connector body. In step 910, a PCB panel is provided that may have at least one device PCB and at least one PCB rail disposed on the periphery of the device PCB. In step 915, the alignment features on the connector may be aligned with corresponding apertures in the PCB panel and the connector can be seated on the PCB panel. In step 920, the connector may be attached to the device PCB. In some embodiments the connector may have leads that may be soldered to corresponding pads on the device PCB. In other embodiments, the connector may have press-fit pins that may be pressed into corresponding holes in the device PCB. In step 925, the PCB rails may be removed from the device PCB. In some embodiments this may comprise removing tabs that connect the PCB rails to the device PCB. This may be accomplished with, for example, a punching operation, a laser operation, a sawing operation, or a breaking operation. In step 930, if an SMT cap was installed on the connector, it may now be removed, leaving only the connector attached to the device PCB. In step 935 the device PCB may now be installed in the electronic device.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An electrical connector comprising:

a connector body, mountable to a printed circuit board;

a removable cap, affixed to an exterior face of the connector body; and wherein the removable cap comprises an alignment feature protruding from a bottom surface of the removable cap, the alignment feature fittable within an aperture in the printed circuit board.

2. The electrical connector set forth in claim 1, wherein the alignment feature is a pin and the aperture is a hole.

3. The electrical connector set forth in claim 1, wherein the alignment feature is a pin and the aperture is a slot.

4. The electrical connector set forth in claim 1, wherein the cap comprises two alignment features that are pins and the printed circuit board comprises two apertures that are holes.

5. The electrical connector set forth in claim 1, wherein the connector body comprises an alignment feature that protrudes from a bottom surface of the connector and is fittable with an aperture in the printed circuit board.

6. A removable electrical connector cap comprising:

a tongue for attaching the connector cap to an exterior face of an electrical connector body; and an alignment feature protruding from a bottom surface of the connector cap, the alignment feature fittable within an aperture in a printed circuit board.

7. The removable electrical connector cap set forth in claim 6 wherein the tongue includes one or more retention mechanisms configured to engage with a retention feature on a receptacle connector.

8. The removeable electrical connector cap set forth in claim 7 wherein the one or more retention mechanisms comprise first and second recesses formed on opposing sides of the tongue.

9. A method of orienting an electrical connector on a printed circuit board, the method comprising:

mounting a removable cap to an exterior face of the electrical connector;

wherein the removable cap comprises an alignment feature protruding from a bottom surface of the cap and the printed circuit board comprises an aperture sized to receive the alignment feature; and placing the electrical connector with the removable cap on the circuit board and fitting the alignment feature into the aperture.

10. A PCB panel for use in making electronic device PCBs, the PCB panel comprising:

an outer frame having a plurality of removable tabs connecting the outer frame to a plurality of device boards disposed within the outer frame;

the outer frame further comprising an aperture for receiving an alignment feature of an electronic component;

wherein the aperture is located adjacent to an electronic component bonding pad disposed on the device board;

a plurality of inner rails disposed between the plurality of device boards and starting at a side of the outer frame and ending at an opposite side of the outer frame; and wherein the inner rails are connected to the device boards by one or more removable tabs.

11. The removable electrical connector cap set forth in claim 6, wherein the alignment feature is a pin and the aperture is a hole.

12. The removable electrical connector cap set forth in claim 6, wherein the alignment feature is a pin and the aperture is a slot.

13. The removable electrical connector cap set forth in claim 6, wherein the alignment feature comprises two pins and the aperture comprises two holes.

14. The removable electrical connector cap set forth in claim 6, wherein the connector body comprises a second alignment feature that protrudes from a bottom surface of the connector body and is fittable with a second aperture in the printed circuit board.

15. The method of claim 9, wherein the alignment feature is a pin and the aperture is a hole.

16. The method of claim 9, wherein the alignment feature is a pin and the aperture is a slot.

17. The method of claim 9, wherein the alignment feature comprises two pins and the aperture comprises two holes.

18. The method of claim 9, wherein the electrical connector comprises a second alignment feature that protrudes from a bottom surface of the connector body and is fittable with a second aperture in the printed circuit board.

19. The PCB panel of claim 10, wherein the alignment feature is a pin and the aperture is a hole.

20. The method of claim 10, wherein the alignment feature is a pin and the aperture is a slot.

* * * * *